US005593314A

United States Patent [19]

Lincoln

[11] Patent Number: 5,593,314

[45] Date of Patent: Jan. 14, 1997

[54] STAGGERED TERMINAL ARRAY FOR MOD PLUG

[75] Inventor: Clifford F. Lincoln, Atlanta, Ga.

[73] Assignce: The Whitaker Corporation, Wilmington, Del.

[21] Appl. No.: 381,383

[22] Filed: Jan. 31, 1995

[51] Int. Cl.[6] ..... H01R 4/24

[52] U.S. Cl. ..... 439/418

[58] Field of Search ..... 439/395, 404, 439/405, 418, 676, 344, 460, 941

[56] References Cited

U.S. PATENT DOCUMENTS

| | | | |
|---|---|---|---|
| 4,054,350 | 10/1977 | Hardesty | 439/460 |
| 4,193,658 | 3/1980 | Dittmann et al. | 439/418 |
| 4,262,984 | 4/1981 | Takahashi | 439/405 |
| 4,431,246 | 2/1984 | Vaden | 339/97 R |
| 4,566,749 | 1/1986 | Johnston | 339/95 D |
| 4,601,530 | 7/1986 | Coldren et al. | 339/103 M |
| 4,607,905 | 8/1986 | Vaden | 339/176 M |
| 4,648,678 | 3/1987 | Archer | 339/99 R |
| 4,697,862 | 10/1987 | Hasircoglu | 439/404 |
| 4,713,023 | 12/1987 | Bixler et al. | 439/393 |
| 4,767,355 | 8/1988 | Phillipson et al. | 439/425 |
| 4,950,176 | 8/1990 | Cocco et al. | 439/344 |
| 5,118,310 | 6/1992 | Stroede et al. | 439/405 |
| 5,145,401 | 9/1992 | Archer | 439/395 |
| 5,147,215 | 9/1992 | Pritulsky | 439/344 |
| 5,186,647 | 2/1993 | Denkmann et al. | 439/395 |
| 5,186,649 | 2/1993 | Fortner et al. | 439/460 |
| 5,194,014 | 3/1993 | McClune et al. | 439/404 |
| 5,269,708 | 12/1993 | DeYoung et al. | 439/676 |
| 5,274,918 | 1/1994 | Reed | 29/882 |
| 5,310,360 | 5/1994 | Peterson | 439/571 |
| 5,312,273 | 5/1994 | Andre et al. | 439/607 |
| 5,376,018 | 12/1994 | Davis et al. | 439/395 |

*Primary Examiner*—Neil Abrams
*Assistant Examiner*—Brian J. Biggi

[57] ABSTRACT

This invention relates to an electrical connector, such as a modular plug, which offers improved transmission performance, particularly reduced crosstalk and decreased insertion loss. The connector, in its preferred embodiment, comprises a dielectric housing having a central cavity therein extending from a conductor receiving end to a conductor termination end. The termination end includes a plurality of individual staggered slots, each slot receiving an insulated conductor, and means communicating with each slot for receiving a single insulation piercing blade to electrically engage a conductor within the slot. The blades are arranged in plural longitudinally aligned planes and consist of an insulation piercing end and an opposite end for electrically engaging complementary terminals in a matable connector. The blades are further aligned in staggered relationship in two transverse planes while the respective insulation piercing ends are transversely staggered. By this arrangement decreased capacitance coupling and mutual inductances between adjacent conductors is achieved.

4 Claims, 5 Drawing Sheets

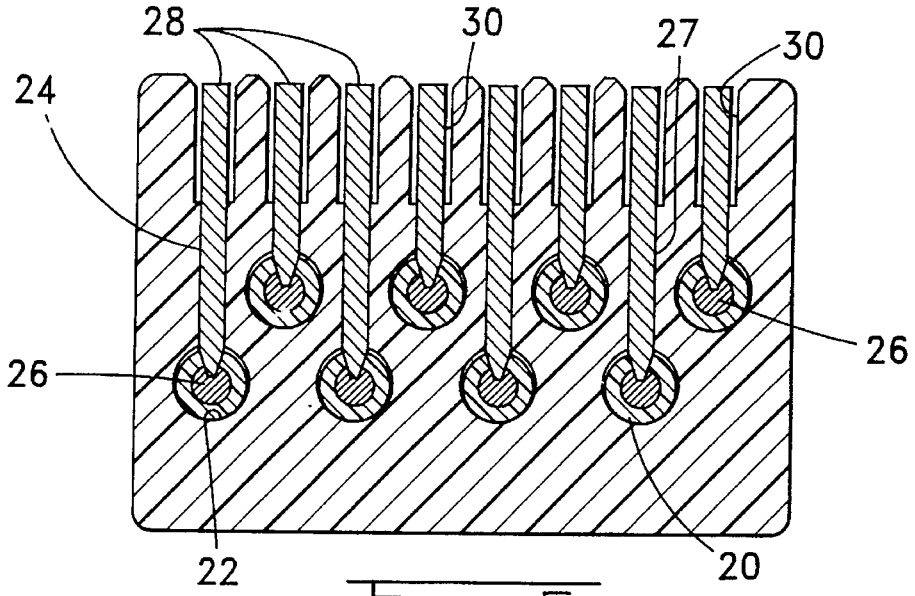
Fig. 5
Fig. 6
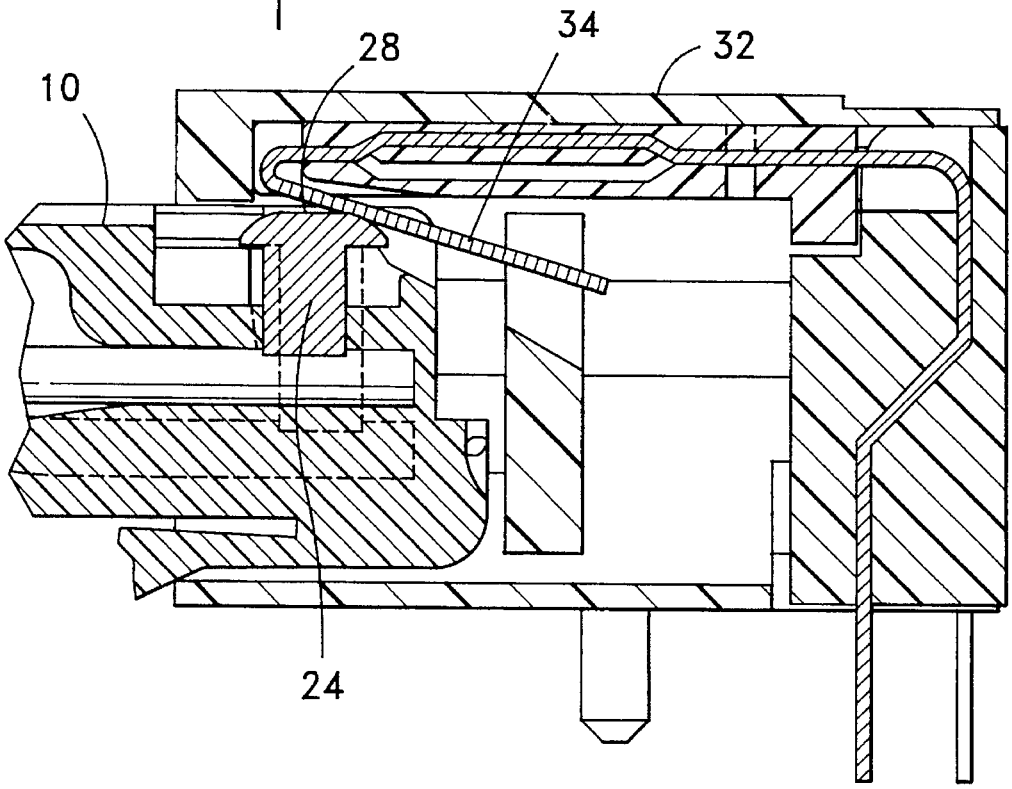

STAGGERED TERMINAL ARRAY FOR MOD PLUG

BACKGROUND OF THE INVENTION

This invention is directed to an improved electrical connector, of the modular plug type, that offers decreased Near End Cross Talk (NEXT) and decreased insertion loss at high transmission frequencies through a decreased capacitance coupling between adjacent terminals.

The design of modular plugs and their complementary modular jacks or receptacles, are dictated by FCC regulations to ensure mating engagement. Notwithstanding such regulations, the present invention preferably teaches a unique terminal array for a modular plug that meets the requirements for matability with approved modular jacks.

By way of brief background, an approved modular jack includes a housing having a cavity therein of a size for receiving a modular plug, where the cavity is provided with plural, cantilevered spring contacts which correspond to a like plurality of contact terminals in the mating modular plug. A typical modular plug receives discrete, insulated, stranded or solid conductors in conductor-receiving troughs or slots formed in a dielectric housing. Flat, blade-like metallic terminals are then inserted into individual vertically oriented slots in the housing in a generally side-by-side arrangement with contact portions thereof extending into engagement with the conductors. When the plug is inserted into a modular jack, the cantilevered portions of the terminals in the jack engage portions of associated terminals in the plug.

Since FCC approval of the architecture of modular jacks and plugs, efforts have continued toward improving the components, such as the introduction of a strain relief to the conductors, as exemplified by U.S. Pat. No. 4,607,905. Additionally, to facilitate loading and termination of the conductors in the modular plug, load bars or wire organizers were developed, an example thereof being taught by U.S. Pat. No. 4,713,023. An earlier version is disclosed in U.S. Pat. No. 4,601,530, assigned to the assignee hereof. The latter patent teaches a preloaded wire organizer for a modular type plug. Specifically, the patent teaches the process of preloading wires into a wire holder which locates the leading ends of the wires at the same pitch as the troughs or slots in the connector housing. The wire holder, supported by the wires, is then inserted into and along the cavity of the housing until it abuts a tapered throat at the entrance to the troughs. Further advance of the assembly feeds the discrete wires through the wire holder into the respective troughs guided by the throat, while the wire holder remains adjacent the tapered throat.

With these prior art improvements, the architecture of the plug and jack were maintained. It was not until relatively recently that communication equipment and needs arose requiring improved performance at higher operating frequencies. From this evolved new technical standards, known in the art as Category 5 products, where operating frequencies may be 100 MHz or higher. However, development of Category 5 products, such as modular plugs and jacks, had to proceed within the guidelines of the FCC regulations, particularly the architecture.

U.S. Pat. No. 5,186,647 represents a recent approach to improve operating performance in a modular jack, for example, by imposing an overlapping arrangement of selected spring contacts. Recently, Stewart Connector Systems, Inc. of Glen Rock, Pa., introduced a Category 5 performing modular plug utilizing a sliding wire management or load bar, where such bar contains two rows, each with four through holes, to receive the standard eight wires of a cable. To use the management bar, the user is advised to arrange the wires in two equal sets, and cut each set of four at a 45° angle such that no two wires are of the same length. With the prepared wires, the wires are individually fed into the holes of the wire organizer, in sliding engagement therewith, then trimmed to the same length. For the loading step, the wire organizer is first pushed to the end of the trimmed wires, then inserted into the connector housing. In the fashion of U.S. Pat. No. 4,601,530, noted earlier, when the wire organizer can no longer move forward, the wires are pushed beyond the wire organizer into a position to be individually terminated, as known in the art.

The present invention, while continuing to adhere to the FCC regulations on architectural requirements, discovered a way to achieve Category 5 performance through a unique terminal contact arrangement in the modular plug. This discovery will become apparent in the further description which follows, particularly when read in conjunction with the accompanying drawings.

SUMMARY OF THE INVENTION

This invention relates to an electrical connector, preferably a modular plug type connector, offering increased crosstalk performance. The connector in its preferred embodiment comprises a dielectric housing having a central cavity therein extending from a conductor receiving end to a conductor termination end. The termination end includes a plurality of individual staggered slots or troughs with each slot or trough receiving an insulated conductor, and means communicating with each slot or trough for receiving a single respective insulation piercing blade to electrically engage a conductor within the slot or trough. The blades are arranged in plural longitudinally aligned planes and consist of an insulation piercing end and an opposite end for electrically engaging complementary terminals in a matable connector. The blades are further aligned in staggered relationship in two transverse planes while the respective insulation piercing ends are transversely staggered. That is, the blades are staggered front to back, and the lower ends are staggered up and down. By this arrangement the present invention achieves a decreased capacitance coupling and mutual inductances between adjacent contact terminals and conductors.

BRIEF DESCRIPTION OF THE DRAWINGS

FIGS. 2 and 3 are longitudinal sectional views of partially terminated electrical connectors according to this invention.

FIG. 5 is a transverse sectional view of a fully terminated connector, such as a modular plug, taken through the terminated section to further illustrate the staggered relationship of the conductors.

FIG. 6 is a partial, longitudinal sectional view showing a terminated electrical connector according to this invention, and mated with a complementary electrical connector, such as a modular jack or receptacle.

DETAILED DESCRIPTION OF THE PREFERRED EMBODIMENT

This invention relates to a high performance electrical connector, such as a modular plug, for use in Category 5 products. Such connector, illustrated in the several FIGURES, offers decreased Near End Cross Talk (NEXT) and decreased insertion loss at high transmission frequencies through a decreased capacitance coupling between adjacent terminals. Though the invention has broad application, it has particular utility in a modular plug, a connector known in the art for the transmission of data in communication systems. Accordingly, the further description will be limited to such preferred application.

Before describing the invention, as it is illustrated by the several FIGURES, a brief background on Category 5 products may be helpful. NEXT loss may be defined as a measure of signal coupling from one circuit to another within a connector and is derived from swept frequency voltage measurements on short lengths of 100 ohm twisted-pair test leads terminated to the connector under test. A balanced input signal is applied to a disturbing pair of the connector while the induced signal on the disturbed pair is measured at the near-end of the test leads. In other words, NEXT loss is the way of describing the effects of signal coupling causing portions of the signal on one pair to appear on another pair as unwanted noise. By way of example, at a frequency of 100 MHz, Category 5 products currently must exhibit a dB reading of at least 40.0. Insertion loss, or attenuation, may be defined as the inductive and capacitive coupling from an active line or lines into another, causing degradation of signals. This has been recognized for years as a performance limitation to increased data communication rates.

Figure 1:
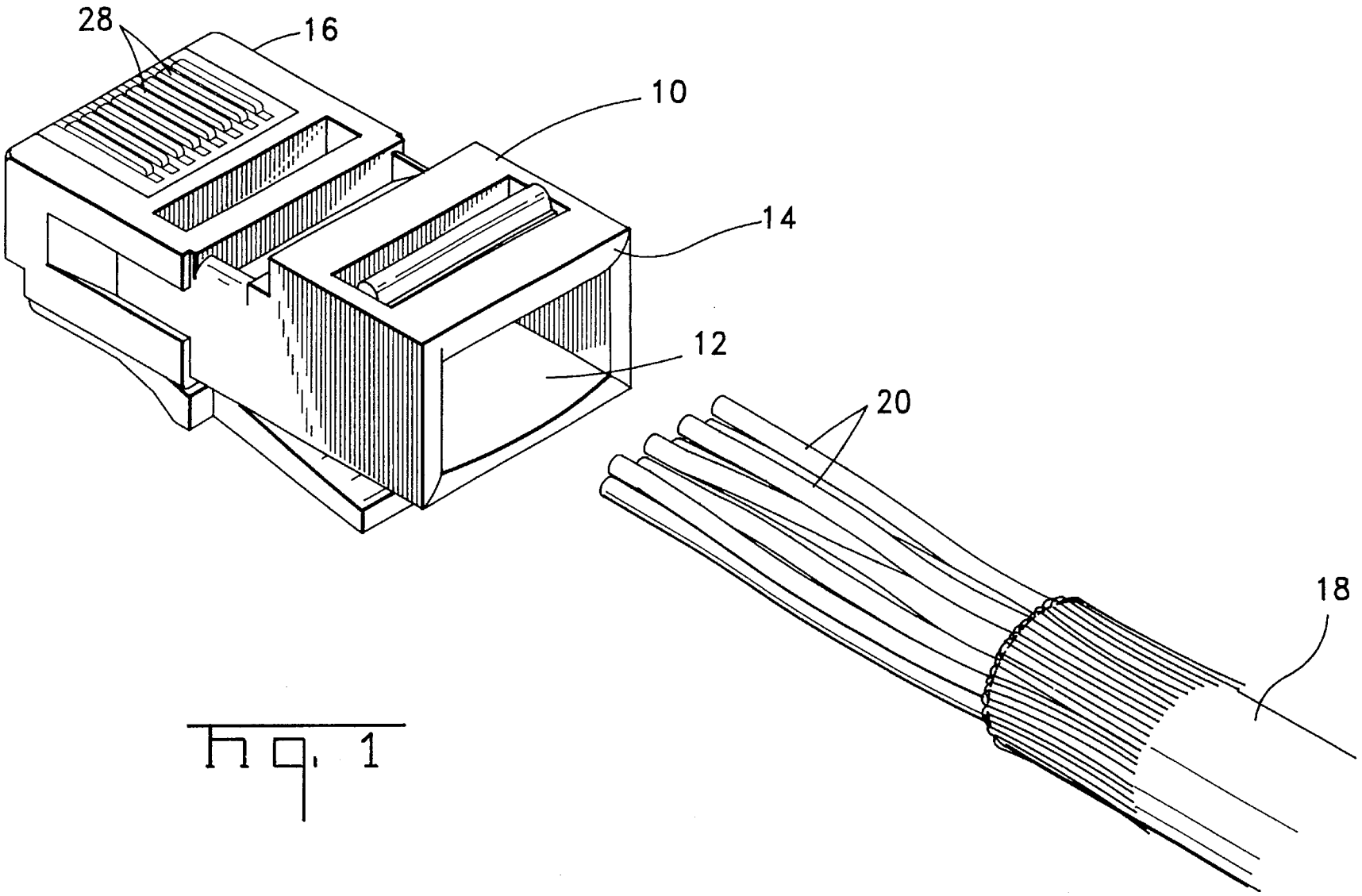
FIG. 1 is an exploded perspective view of an electrical connector, such as a modular plug, in which the unique termination scheme of this invention for terminating the discrete, insulated conductors of a cable may be practiced.
Figure 2:
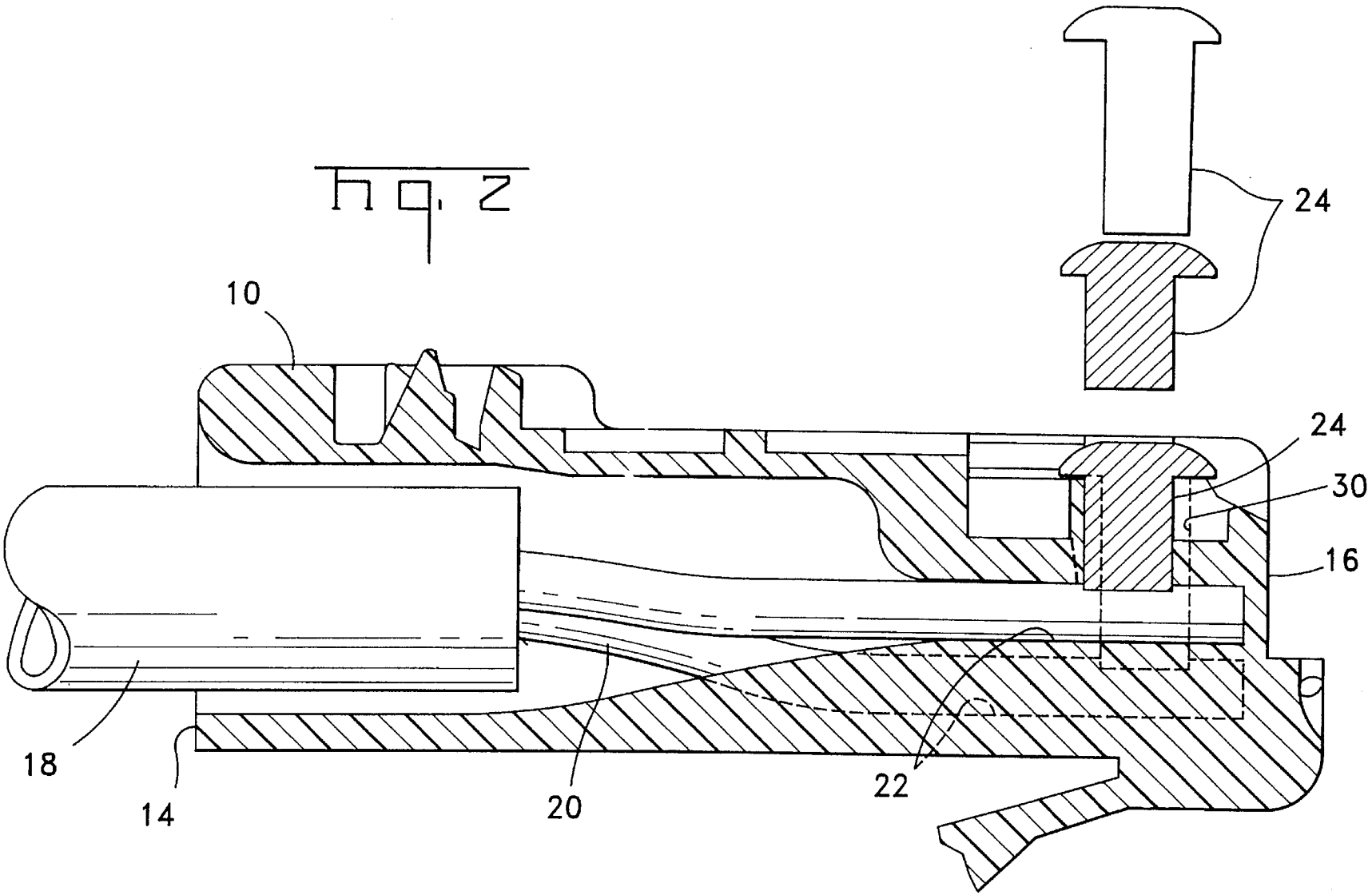
Figure 7:
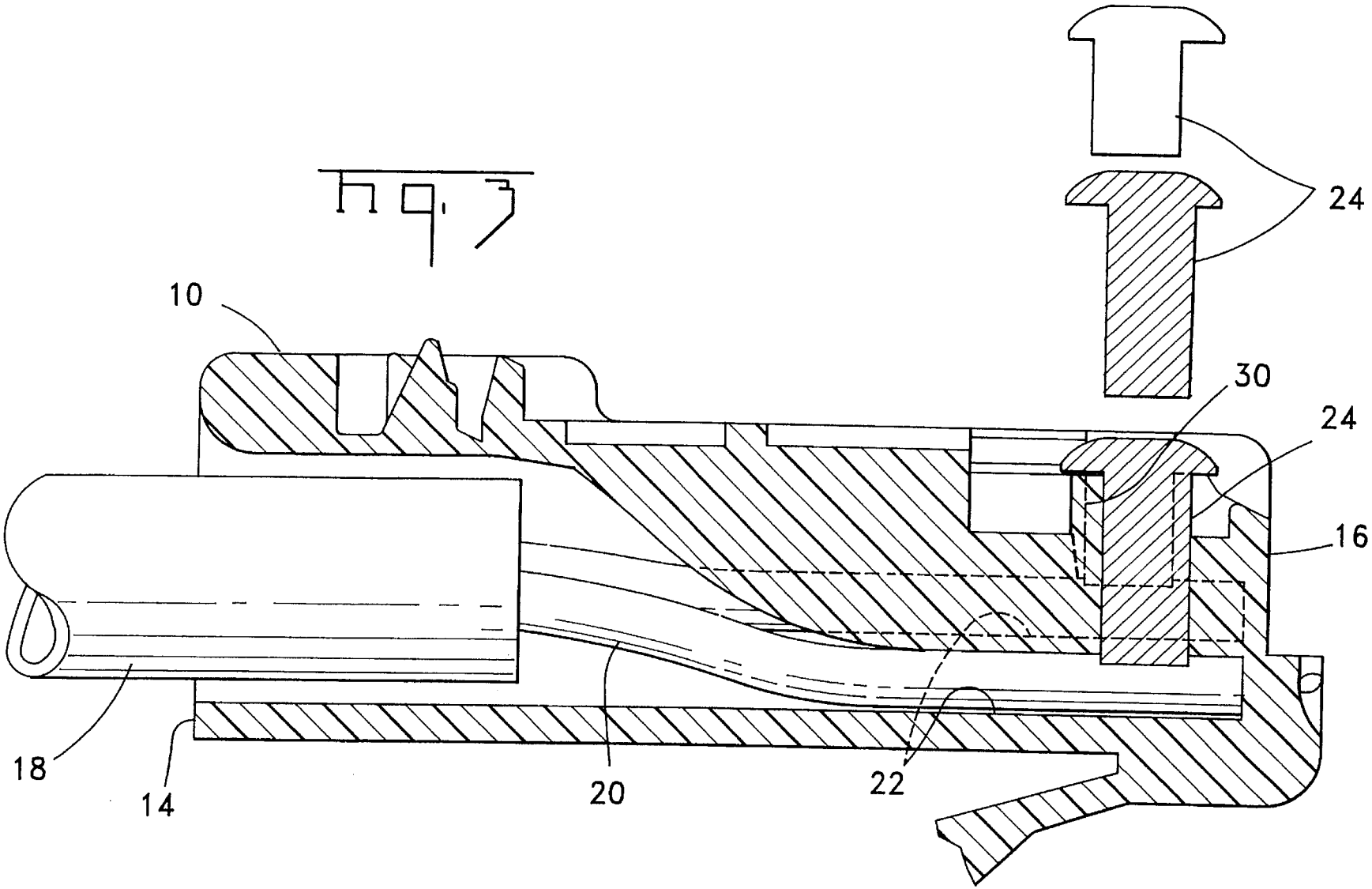

Turning now to the several FIGURES, FIGS. 1 to 3 illustrate a modular plug housing 10 characterized by a central cavity 12 extending from a conductor receiving end 14 to a conductor termination end 16, as known in the art, and as covered by FCC regulations. Poised for entry into the conductor receiving end 14, is a multiconductor cable 18 containing plural pairs of insulated conductors 20, typically four pairs.

Figure 4:
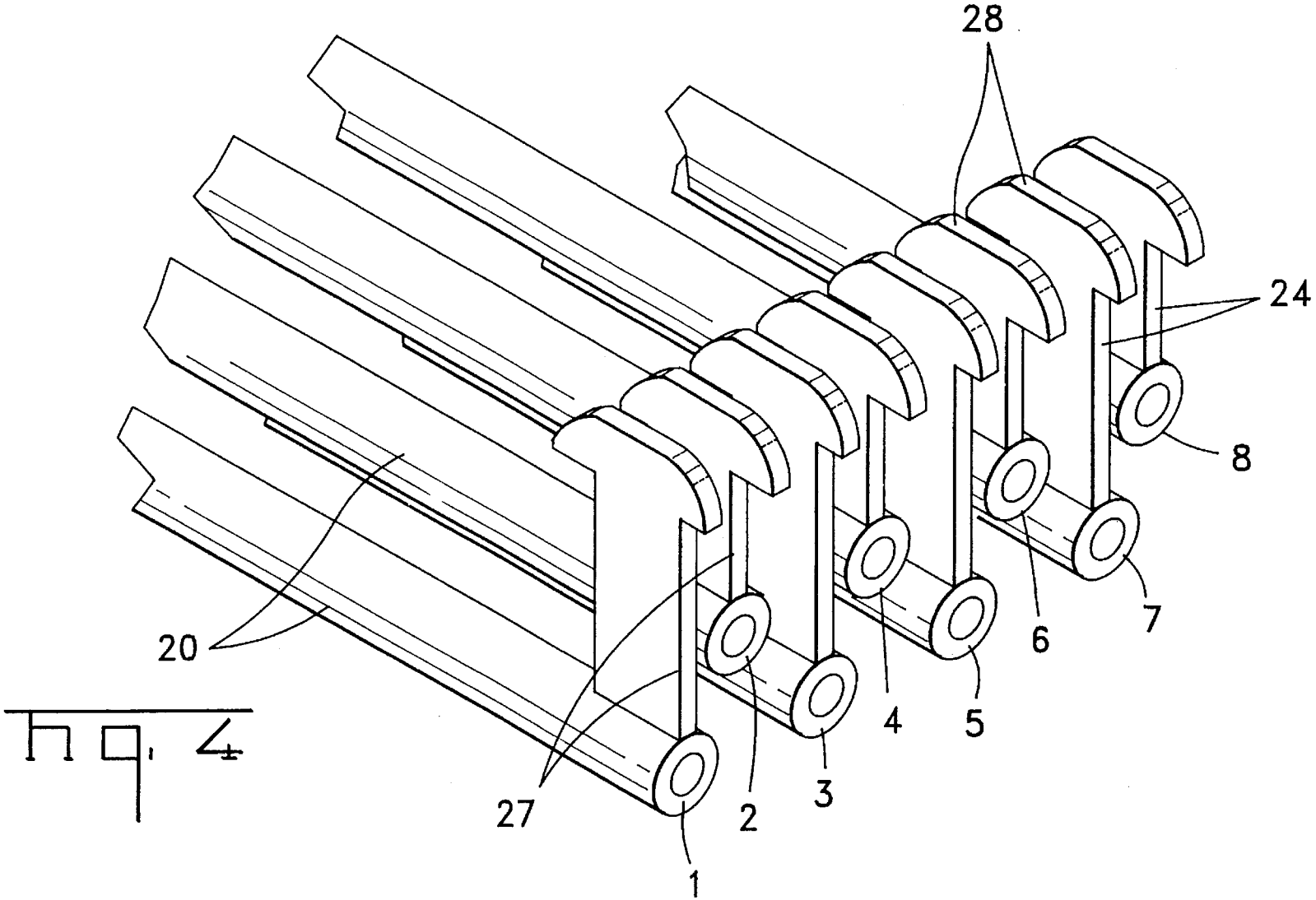
FIG. 4 is a partial perspective view illustrating the staggered relationship, both front and rear and up and down, for the discrete, insulated conductors to be terminated within the electrical connector.

FIGS. 2 and 3 illustrate the manner of loading and terminating the insulated conductors 20. Extending forwardly from the cavity 12 are plural slots or troughs 22 arranged in one of two vertically spaced planes. As best illustrated in FIGS. 4 and 5, the conductors 20 are aligned in the two planes in a staggered fashion, with adjacent conductors being in different planes. That is, if the conductors are numbered sequentially from 1 to 8, the odd numbered conductors may lie in the lower plane, while the even numbered conductors lie in the other or upper plane. This arrangement is distinctly different from conventional modular plugs where the array of conductors are aligned in a single plane.

In addition to staggering the conductors 20 in plural horizontal planes, the conductor termination end 16 has been modified to arrange the insulation piercing blades 24 in a front-to-rear staggered relationship. The blades 24, as best seen in FIG. 5, are provided with a tapered insulation piercing edge 26 that is pressed into and through the conductor insulation in electrical contact with the conductor core, a practice well known in the termination of modular plugs. A distinct feature of this invention, as best seen in FIG. 4, staggers the blades 24 front-to-rear. In combination with the staggered conductors in different planes, the blades 24 are designed with different length shanks 27, where the difference in length is equal to the distance between the respective horizontal planes of the conductors. By this arrangement, the opposite or contact ends 28 lie in a common plane, see FIG. 5. Further, to present an aligned array of contact ends 28, for mating with a complementary connector, as illustrated in FIG. 6, the generally "T" configured blade 24 may be provided with a shank 27 offset from the center of the contact end 28. FIGS. 2 and 3 illustrate clearly this aspect of the invention. FIG. 2, for example, shows a "short" blade poised for entry into the connector, typically a slot 30 as shown in FIG. 5, with the shank 27 offset toward the rear. FIG. 3 is a complementary view to FIG. 2, but showing the "long" blade, poised for entry into a slot 30, having its shank 27 offset toward the front.

FIG. 6 is a partial sectional view illustrating the manner of mating the modular plug housing 10 with a complementary modular jack 32, where such jack, as known in the art, includes a plurality of cantilevered contact arms 34 which electrically engage respective contact ends 28 of the terminating blades 24. Because the contact ends 28 are presented in an aligned array, no modifications are required of the modular jack to receive the connector of this invention.

To further illustrate the unique advantages and improvements over conventional modular plugs, a series of crosstalk tests or calculations were conducted on three variations of 8-conductor arrangements within a modular plug housing, including the staggered arrangement of this invention. A test plug qualification test, in accordance with the preliminary specification EIA/TIA sp. 2840 for Category 5 products, was conducted of the three arrangements. The tests measure crosstalk loss in an unmated state with 100Ω resistors connected in parallel with 100Ω test leads where they connect to the balans. That is, for an 8-conductor connector in which there are six test plug pair combinations, where the pin combination of 4 & 5–3 & 6 represent the most critical combination, a 100Ω resistor is connected in parallel with the test leads and NEXT is measured. In accordance with the standard, in order to minimize inductive effects, the resistor leads were kept as short as possible. For each of the six pair combinations, the measured NEXT loss of the open circuit plug, with 100Ω resistors connected in parallel with the UTP test leads, shall measure for the pin combination 4 & 5–3 & 6 at least −40 dB, where the higher the negative value the better the performance. This measurement is sometimes referred to as a "terminated open circuit" or TOC test. In addition, for pin combination 4 & 5–3 & 6, the difference between the NEXT loss measured at 100 MHz and the NEXT loss measured at 10 MHz for this set-up shall be 20±0.5 dB. The three test arrangements were as follows:

where pair 3 & 6 was energized and pair 4 & 5 was monitored, and that there was a crossover of pair 3 & 6:

A. standard prior art load bar with the conductors aligned in a common plane, with the blade terminations aligned in a common transverse plane, B. Stewart Stamping load bar with the conductors alternately arranged in one of two planes, and the blade termination aligned in a common transverse plane, and C. a staggered arrangement according to the invention.

Except for the arrangement of the conductors and position of the terminating blades, the test conditions were identical. 24 ga. insulated wires were employed, where adjacent aligned wires were on a center-line of 0.040 inches. The spacings between adjacent non-aligned wires of B and C were 0.056 inches. Finally, the terminating blade arrangement for adjacent blades for C were offset by about 0.047 inches. TOC NEXT results of the three analysis/tests are listed below.

TEST A

| Stimulus Freq. of 3 & 6 (MHz) | Analysis/Test (db) | Spec. db) |
|---|---|---|
| 1.00 | -80 | <-65 |
| 4.00 | -66 | <-65 |
| 8.00 | -63 | <-62 |
| 10.00 | -62 | <-60 |
| 16.00 | -57 | <-56 |
| 20.00 | -55 | <-54 |
| 25.00 | -53 | <-52 |
| 31.25 | -52 | <-50 |
| 62.50 | -45 | <-44 |
| 100.00 | -41 | <-40 |

TEST B

| Stimulus Freq. of 3 & 6 (MHz) | Analysis/Test (db) | Spec. db) |
|---|---|---|
| 1.00 | -83 | <-65 |
| 4.00 | -67 | <-65 |
| 8.00 | -65 | <-62 |
| 10.00 | -64 | <-60 |
| 16.00 | -61 | <-56 |
| 20.00 | -58 | <-54 |
| 25.00 | -58 | <-52 |
| 31.25 | -54 | <-50 |
| 62.50 | -48 | <-44 |
| 100.00 | -44 | <-40 |

TEST C

| Stimulus Freq. of 3 & 6 (MHz) | Analysis/Test (db) | Spec. db) |
|---|---|---|
| 1.00 | -88 | <-65 |
| 4.00 | -75 | <-65 |
| 8.00 | -72 | <-62 |
| 10.00 | -70 | <-60 |
| 16.00 | -67 | <-56 |
| 20.00 | -64 | <-54 |
| 25.00 | -62 | <-52 |
| 31.25 | -60 | <-50 |
| 62.50 | -54 | <-44 |
| 100.00 | -50 | <-40 |

In the three analysis/tests, a significant improvement in NEXT loss at 100 MHz was demonstrated from the prior art "aligned" arrangement of Test A, to the intermediate arrangement of TEST B, and finally to the staggered arrangement of this invention in TEST C, namely, from −41 dB to −50 dB.

I claim:

1. An electrical connector of the modular plug type, comprising:

a dielectric housing which opens inwardly to a plurality of conductor receiving slots disposed in a vertically staggered array, the slots being arranged to receive a respective plurality of insulated conductors extending longitudinally in the housing, the housing carrying a plurality of insulation piercing blades which are arranged for being driven into respective ones of said slots, each of said blades being substantially planar with the plane of each blade being aligned in a respective longitudinal plane, each of said blades having an insulation piercing end for electrically engaging a respective one of said conductors, and a contact end for electrically engaging a respective terminal in a matable connector, said insulation piercing ends being arranged in a vertically staggered array corresponding to the vertically staggered array of said slots, and said blades being further arranged in a longitudinally staggered array, thereby reducing mutually opposed areas of adjacent said blades so as to decrease capacitive coupling and mutual inductance between said adjacent blades during high speed signal transmission.

2. The electrical connector according to claim 1, wherein said contact ends are disposed in a common horizontal plane.

3. The electrical connector according to claim 1, wherein said contact ends are transversely aligned.

4. The electrical connector according to claim 1, wherein each said blade has a shank connected between its said insulation piercing end and its said contact end, and said blades are arranged in said longitudinally staggered array by at least one of said blades having a center of its said shank being offset from a center of its said contact end.

* * * * *